United States Patent [19]

Pillis et al.

[11] Patent Number: 4,609,329

[45] Date of Patent: Sep. 2, 1986

[54] MICRO-PROCESSOR CONTROL OF A MOVABLE SLIDE STOP AND A MOVABLE SLIDE VALVE IN A HELICAL SCREW ROTARY COMPRESSOR WITH AN ENCONOMIZER INLET PORT

[75] Inventors: Joseph W. Pillis, Hagerstown, Md.; Hans C. Wile, Waynesboro, Pa.

[73] Assignee: Frick Company, Waynesboro, Pa.

[21] Appl. No.: 720,323

[22] Filed: Apr. 5, 1985

[51] Int. Cl.[4] ..... F04B 49/06; F01C 1/16

[52] U.S. Cl. ..... 417/282; 417/310; 418/15; 418/201

[58] Field of Search ..... 417/282, 310; 418/15, 418/201-203; 73/707

[56] References Cited

U.S. PATENT DOCUMENTS

| | | | |
|---|---|---|---|
| Re. 29,283 | 6/1977 | Shaw | 418/201 |
| 1,818,258 | 8/1931 | Isaacks | 73/707 |
| 2,519,913 | 8/1950 | Lysholm | 418/15 |
| 3,432,089 | 3/1969 | Schibbye | 417/310 |

*Primary Examiner*—John J. Vrablik

*Attorney, Agent, or Firm*—Dowell & Dowell

[57] ABSTRACT

A variable volume ratio screw compressor has a side load inlet port for the injection of refrigerant vapor into the interlobe volume. In order to improve efficiency, overcompression and undercompression are avoided by varying the location of the radial discharge port to give the compressor an internal volume ratio matched to the pressure of the system in which the compressor operates. This is accomplished in the present application by locating a pressure sensing port no earlier than and preferably later in the compression than the side load injection port, but early enough in the compression that it will not communicate with the discharge port. The pressure that is sensed in the sensing port is used to predict the actual peak pressure in order that maximum efficiency may be obtained as a result of matching the internal volume ratio to the pressure ratio of the system.

12 Claims, 5 Drawing Figures

MICRO-PROCESSOR CONTROL OF A MOVABLE SLIDE STOP AND A MOVABLE SLIDE VALVE IN A HELICAL SCREW ROTARY COMPRESSOR WITH AN ENCONOMIZER INLET PORT

FIELD OF THE INVENTION

This invention relates to helical screw type compressors with axial fluid flow in which an automatically variable volume ratio is provided and provision is made for injecting refrigerant vapor into the interlobe volume.

DESCRIPTION OF THE PRIOR ART

The present invention is particularly adapted as an application to the invention described in application Ser. No. 659,038, filed Oct. 10, 1984, by David A. Murphy, and Peter C. Spellar, now U.S. Pat. No. 4,516,914. Accordingly, the present inventors make no claim of inventorship in the subject matter of that application. Its disclosure is used herein as an illustration of subject matter with which the present invention may be employed.

The use of economizers in helical compressors is well known. See, for example, Chapter 12, Page 12.18 of the 1983 *Equipment Handbook of American Society of Heating, Refrigerating and Air Conditioning Engineers, Inc.* In this handbook the economizers are described as follows:

> "Helical screw compressors are now available with a secondary suction port that is between the primary suction and the discharge port. This arrangement provides an improvement in system capacity and increases the system COP [coefficient of performance] (see FIG. 18). This is commonly known as an economizer connection."

Economizers are also described in prior patents including Schibbye, U.S. Pat. No. 3,432,089; and Moody et al., U.S. Pat. No. 3,885,402.

It is also known in the art that it is desirable to match the closed thread pressure at the discharge side of the compressor with the line pressure of the gas at the high pressure discharge port in order to avoid inefficiency which would result from overcompression or undercompression within the compressor. The patent to Shaw, U.S. Pat. No. Re. 29,283 is an example of the foregoing.

Shaw attempts to accomplish this by "a closed thread sensing port 72 which opens up to the closed thread and permits sampling of the pressure of the compressed working fluid at that point in the compression cycle and just prior to discharge." (Shaw, Column 5, lines 58–51). Shaw states that he uses the pressure that is sensed to control the operation of a pilot valve which in turns controls the position of the slide valve. (Column 5, line 40–Column 6, line 62).

SUMMARY OF THE INVENTION

The present invention is directed to optimally locating a pressure sensing port in a variable volume ratio screw compressor having a side load inlet port and using the pressure sensing to predict the peak pressure of the total content of the interlobe volume in order to control the location of the radial discharge port and obtain efficient operation of the compressor by avoiding undercompression or overcompression.

DESCRIPTION OF THE SUBJECT MATTER OF APPLICATION SER. NO. 659,038

Figure 1:
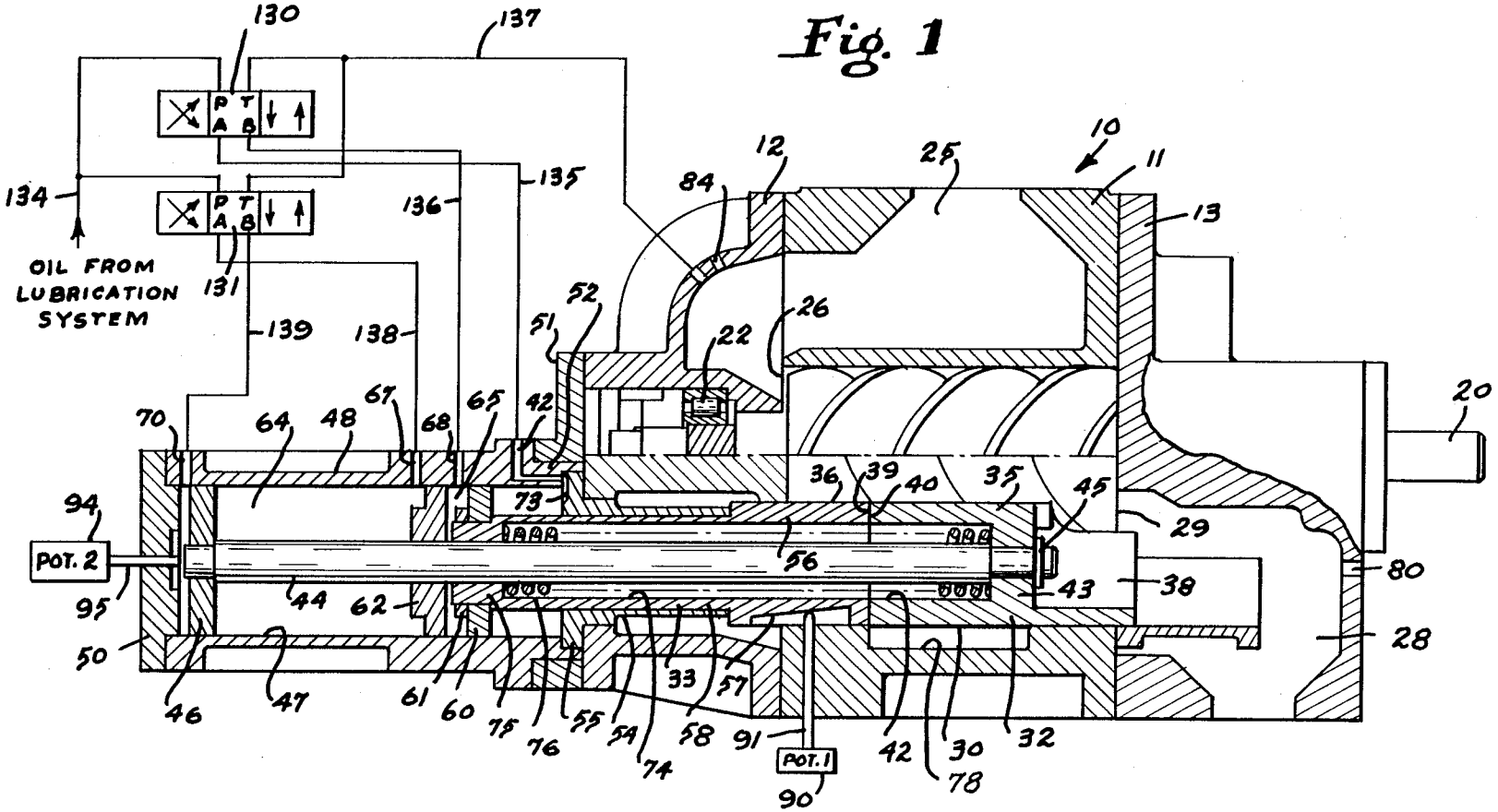
FIG. 1 is a horizontal sectional view of a screw type compressor as disclosed in the application referred to above, Ser. No. 659,038, and with modifications in accordance with the present invention.

With further reference to the drawings a helical screw compressor 10 is illustrated having a central rotor casing 11, an inlet casing 12, and an outlet casing 13 connected together in sealing relationship. The rotor casing has intersecting bores 15 and 16 providing a working space for intermeshing male and female helical rotors or screws 18 and 19 mounted for rotation about their parallel axes by suitable bearings.

Rotor 18 is mounted for rotation on shaft 20 carried in a bearing (not shown) in outlet casing 13, and in bearing 22 carried in inlet casing 12. Shaft 20 extends outwardly from the outlet casing for connection to a motor (not shown) through a suitable coupling (not shown).

The compressor has an inlet passageway 25 in inlet casing 12 communicating with the working space by port 26. A discharge passageway 28 in outlet casing 13 communicates with the working space by port 29 (which is at least partially within the outlet casing 13).

It will be apparent in the illustrated embodiment that in a horizontally positioned machine inlet port 26 lies primarily above a horizontal plane passing through the axes of the rotors and outlet port 29 lies primarily below such plane.

Positioned centrally beneath the bores 15 and 16, and having a parallel axis, is a longitudinally extending, cylindrical recess 30 which communicates with both the inlet and outlet ports.

Mounted for slideable movement in recess 30 is a compound valve member including a slide valve 32 and cooperating member or slide stop 33. The innerface 35 of the slide valve, and the innerface 36 of the slide stop are in confronting relation with the outer peripheries of the rotors 18 and 19 within the rotor casing 11.

The right end of the slide valve (as viewed in FIG. 1) has an open portion 38 on its upper side providing a radial port communicating with the outlet port 29. The left end 39 may be flat or shaped as desired to fit against the right end 40 of the slide stop in order that engagement of the two adjacent ends of the slide valve and slide stop will seal the recess 30 from the bores 15 and 16.

The slide valve has an inner bore 42 and a head 43 at one end. A rod 44 is connected by fastening means 45 at one end to the head through which it extends and at its other end to a piston 46. The piston is mounted to reciprocate in the barrel 47 of cylinder 48 which is connected to and extends axially from the inlet casing 12. A cover or end plate 50 is mounted over the outer end of the cylinder 48. The inlet casing 12 is connected to the cylinder 48 by an inlet cover 51 which receives a reduced diameter end portion 52 of cylinder 48.

Mounted interiorly of the inlet cover 51 is a sleeve 54 having a bulkhead portion 55 at one end and extending longitudinally of the rotor casing. The slide stop 33 has a head portion 56 terminating in the end 40 and the head portion has an inclined slot 57 on its underside sloping upwardly from left to right as viewed in the drawing. The axial length of the slot is adequate to permit the maximum desired movement of the slide stop. From the head portion the slide stop has a main portion 58 which is slideably received within the sleeve 54. At its other end the slide stop has a piston 60 secured by suitable fastening means 61.

A stationary bulkhead 62 is fixed in the cylinder 48 intermediate its ends and separates the interior into an outer compartment 64 in which piston 46 moves, and an inner compartment 66 in which piston 60 moves. Cylinder 48 has fluid ports 67 and 68 closely adjacent each side of the bulkhead 62 communicating with the compartments 64 and 66, respectively. At the outer end of cylinder 48 a fluid port 70 is provided in communication with the compartment 64 but on the opposite side of piston 46. At its inner end the cylinder 48 has port 72 communicating with recess 73 in the outer end face of the bulkhead portion 55 of the sleeve 54 for introducing and removing fluid from the compartment 66 but on the opposite side of piston 60 from the port 68.

The slide stop has an inner bore 74 of matching diameter to that of bore 42 in the slide valve 32 and communicating with that bore. At its other end the slide stop has a head 75 which mounts the piston 60.

A self-unloading coil spring 76 is positioned in the co-axial bores 74 and 42, around rod 44, and tends to urge the slide valve 32 towards the outlet or discharge port 29 and to urge the slide stop into abutting relationship with the bulkhead 62. In such position the slide valve and slide stop are spaced apart a maximum distance (open position).

In operation, the working fluid, such as a refrigerant gas enters the compressor by inlet 25 and port 26 into the grooves of the rotors 18 and 19. Rotation of the rotors forms chevron shaped compression chambers which receive the gas and which progressively diminish in volume as the compression chambers move toward the inner face of the outlet casing 13. The fluid is discharged when the crests of the rotor lands defining the leading edge of a compression chamber pass the edge of port 38 which communicates with the discharge 28. Positioning of the slide valve 32 away from the outlet casing 13 reduces the compression ratio by advancing the opening of the trapped pocket to the discharge port 29. Positioning towards the outlet casing, when the slide valve and slide stop are together, has the opposite effect. Thus, movement of the slide valve varies the internal compression ratio and controls the maximum pressure attained in the trapped pocket prior to its opening to the discharge port 29.

The compressor is constructed to provide a controlled variation in its volumetric capacity simultaneously with controlling its compression ratio. Thus, as will be described, the slide valve and slide stop may be controlled to match the internal compression ratio in the compressor to the system compression ratio as the volumetric capacity is controlled. When the slide valve and slide stop are moved apart, the space therebetween communicates with the intermeshed rotors 18 and 19 to permit working fluid in a compression chamber between the rotors at inlet pressure to remain in communication with the inlet through slot 78 and a passageway (not shown) in casing 11 thereby decreasing the volume of fluid which is compressed. Thus, maximum capacity is provided with the slide valve and slide stop in abutting relation. The nearer the outlet casing the space between the slide valve and the slide stop is positioned, the greater the decrease in capacity from a maximum.

THE CONTROL SYSTEM

A control system is provided for moving the slide valve and slide stop in accordance with a predetermined program to accomplish the aforestated objectives. In order to do this, four variables from the compressor are constantly sensed and fed into an electrical network. Thus, outlet casing 13 has a plug opening 80 connected by conduit 81 to discharge pressure transducer 82. Inlet casing 12 has plug opening 84 connected by conduit 85 to suction pressure transducer 86. Potentiometer 90 has its movable element 91 extending through the wall of rotor casing 11 and engaged with the inclined slot 57 in the slide stop 33 and functioning as P1 to control voltage divider network 92. Potentiometer 94 has its movable element 95 extending through the cylinder cover 50 into engagement with rod 44 of slide valve 32 and functioning as P2 to control voltage divider network 96. The voltage divider network 92 includes calibration resistors R1 and R2 and transmits a 1–5 voltage DC signal to the analog input module 98 by lines 100 and 101. Similarly, voltage divider network 96 includes calibration resistors R3 and R4 and feeds a 1–5 volt signal to the analog input module 98 by lines 102 and 103.

The discharge pressure transducer 82 and suction pressure transducer 86 convert the signal each receives to a 1–5 volt DC signal and sends it by lines 104–107 to analog input module 98.

Module 98 converts the signals it receives to digital signals and transmits these to microcomputer 110. Microcomputer 110 has a program 112 of predetermined nature so that the computer output provides the desired control of the slide valve 32 and slide stop 33. An appropriate readout or display 114 is connected to the computer 110 to indicate the positions of the slide valve and the slide stop based on the signals received from the feedback potentiometers 90 and 94.

From the computer 110, four control signals are provided through the outputs 116, 117, 118 and 119. Thus, the two signals from the voltage divider networks 92 and 96, responsive to slide stop and slide valve position, and the two signals from the discharge and suction pressure transducers 82 and 86, are coupled through the analog input to the microcomputer and processed thereby to deliver appropriate outputs 116 through 119. Outputs 116 and 117 are connected to solenoids 120 and 121 through lines 122 and 123, respectively. Outputs 118 and 119 are connected to solenoids 125 and 126 through lines 127 and 128, respectively.

Solenoids 120 and 121 control hydraulic circuits through control valve 130 which position the slide stop 33. Solenoids 125 and 126 control hydraulic currents through control valve 131 which position the slide valve 32.

Control valve 130 is connected by line 134 to a source of oil or other suitable liquid under pressure from the pressurized lubrication system of the compressor. Line 135 connects the valve 130 to fluid port 72 and line 136 connects the valve to fluid port 68. Oil vent line 137 is connected to the inlet area of the compressor.

Control valve 131 is connected by line 134 to the oil pressure source and by line 137 to the vent. Line 138 connects valve 131 to fluid port 67 and line 139 connects valve 131 to fluid port 70.

In operation, energizing solenoid 120 of valve 130 positions the valve so that flow is in accordance with the schematic representation on the left side of the valve, the flow being from "P" to "B" and thus applying oil pressure via conduit 136 against the left side of piston 60 and simultaneously venting oil from the opposite side of the piston via conduit 135 and in the valve from "A" to "T" to the oil vent. This urges the piston and its associated slide stop to the right, as represented in the drawing.

Energizing solenoid 121 of valve 130 positions the valve so that flow is in accordance with the schematic representation on the right side of the valve, the flow being from "P" to "A" and thus applying oil pressure via conduit 135 against the right side of piston 60 to urge it to the left and simultaneously venting oil from the opposite side of the piston via conduit 136 and in the valve from "B" to "T" to the oil vent.

Similarly, energizing solenoid 125 of valve 131 positions that valve from "P" to "B" to apply pressure through fluid port 70 and venting through fluid port 67 from "A" to "T" to move the slide valve to the right as represented in the drawing. Energizing solenoid 126 of valve 131 positions the valve from "P" to "A" to apply pressure through fluid port 67 and venting through fluid port 70 from "B" to "T" to move the slide valve to the left.

When the compressor is used in a refrigeration system it is normally desired to move its slide valve to maintain a certain suction pressure which is commonly referred to as the "set point". Optionally, other parameters, such as the temperature of the product being processed in a refrigeration system associated with the compressor, may be used as factors affecting the position of the slide valve and, hence, the capacity of the compressor. The system contemplates entering a desired set point into the microcomputer 110 by appropriate switches connected with a control panel, not shown, associated with the display 114. The control panel may also include provision for controlling the mode of operation, e.g., automatic or manual, and the operation of the slide stop, slide valve, and compressor. The readout display 114 from the microcomputer 110 is based on the signals it receives. The necessary electrical connections are made between the control panel and the microcomputer 110 in order to accomplish the desired function by means well known in the art.

The program associated with the microcomputer 110 is such that it will select the proper position for the slide stop 33 based upon the information received from the discharge pressure transducer 82 and the suction pressure transducer 86, and the characteristics of the refrigerant and the compressor. The program is prepared so that it will control the position of the slide valve 32 based upon the suction pressure transducer 86 or other appropriate capacity indication.

Thus, the control system contemplates constantly sensing the four variables, discharge and suction pressure, and the positions of the slide stop and slide valve, and, if necessary, moving the slide stop and slide valve in the appropriate direction until the signals received by the microcomputer 110 are in balance with the positions of the slide stop and slide valve established by the program 112.

The slide valve 32 operates as a floating type of control. It is moved in the direction of loading or unloading in response to a capacity control signal, e.g., derived from the suction pressure transducer 86, but it is not positioned at any precise location relative to any other signal or control. While the capacity control signal is usually based on the suction pressure, it may include other parameters such as the product temperature, as stated above. The outputs from loading and unloading are normally pulsed in a time proportioned arrangement to vary the rate of response of the slide valve with the magnitude of the error of the capacity control signal.

The signal from the potentiometer 94 associated with the slide valve is not used to control its position. However, it is used to indicate its position and such position is used for other purposes including starting the compressor fully unloaded, and where applicable, in multicompressor sequencing.

In contrast, the slide stop is controlled to a precise location, as stated above. The feedback from its potentiometer 90 is used to determine when it is in the desired position.

The feedbacks from the potentiometers for both the slide stop and slide valve are used to determine whether a conflict or overlapping exists between the desired mechanical position of the slide stop and the actual mechanical position of the slide valve. If a conflict exists, the slide valve is temporarily relocated so that the positioning of the slide stop takes precedence.

The system also has provision whereby appropriate controls indicated on the control panel may be operated to permit manual positioning of both the slide valve and the slide stop.

Positioning of the slide valve and slide stop with reference to the rotor casing and to each other permits the desired variations in the compression ratio so that the compressor may be "loaded" or "unloaded" as required by various parameters.

While hydraulic means have been described for moving the slide stop and slide valve, other means well known to those skilled in the art may be used. For example, electric stepper motors or stepper motor piloted hydraulic means may be used if desired.

DESCRIPTION OF A PREFERRED EMBODIMENT OF THE INVENTION

As mentioned above, the present invention may be applied to the subject matter of application Ser. No. 659,038, described above.

The invention will be described for use with a conventional rotor profile having four male lobes 18 and six female lobes 19. The male has a 300° wrap angle, the lobes being 90° apart. The female has a 200° wrap angle, the lobes being 60° apart. The male lobes have crests 18' spaced apart by $\beta$ and lands 18''. The female lobes have crests 19', spaced apart by $\alpha$ and gullies generally indicated at 19''.

Figure 2:
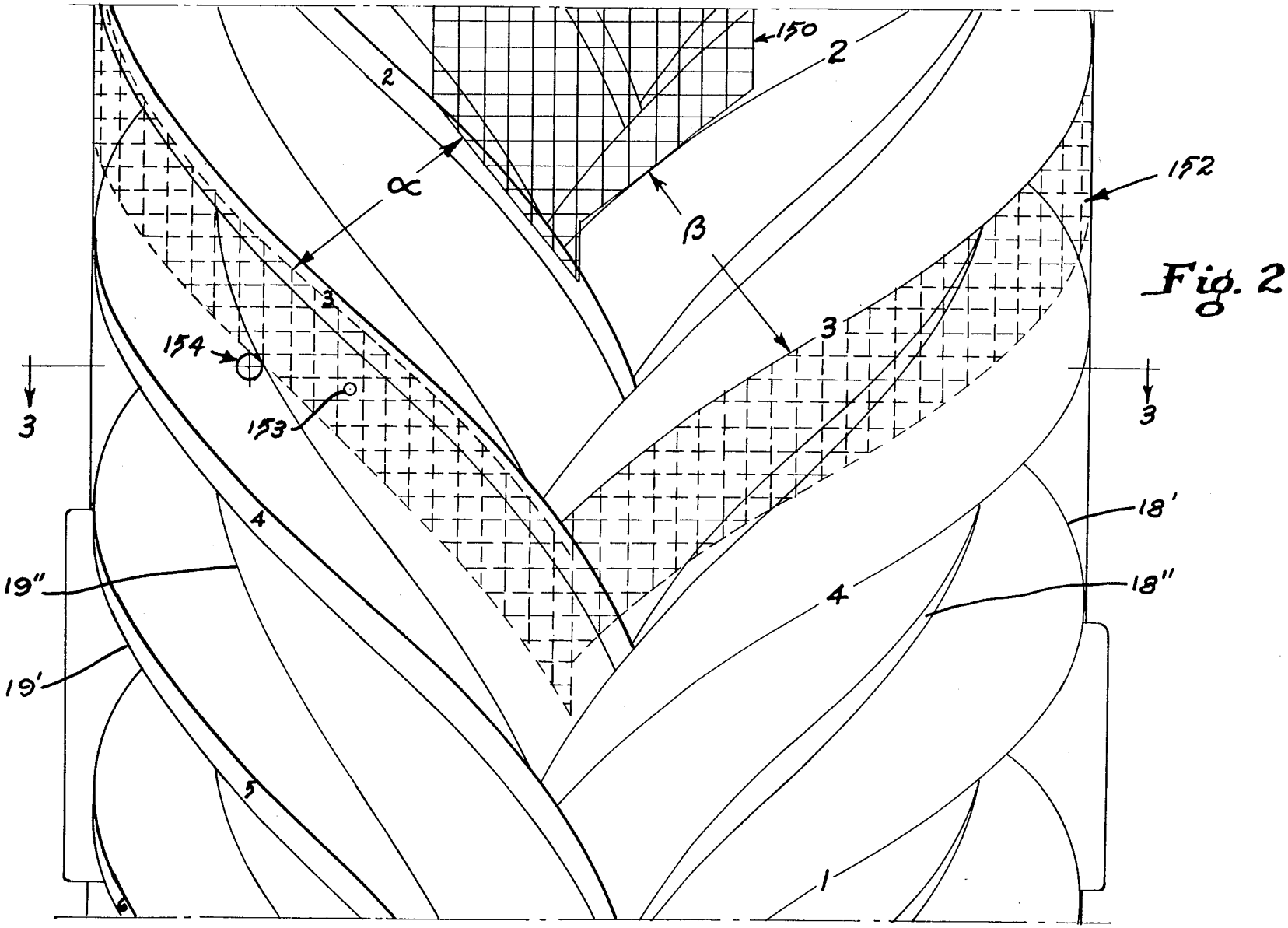
FIG. 2 is a partial bottom view of the compressor of FIG. 1 illustrating the rotor thread arrangement.
Figure 3:
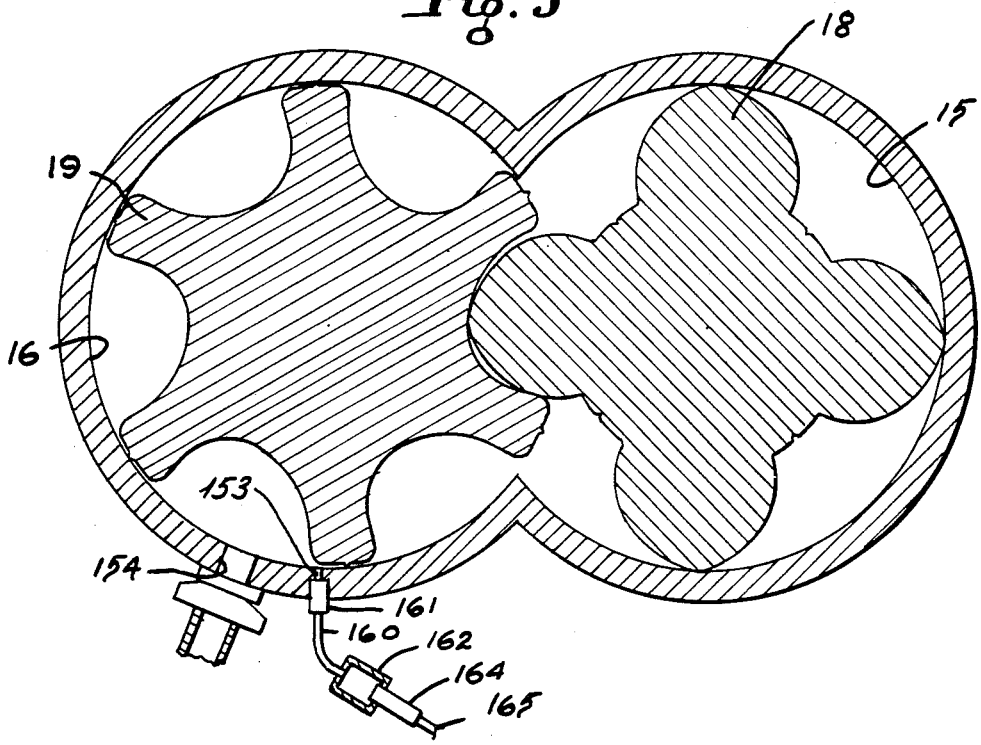
FIG. 3 is a sectional view of a portion of the compressor taken along the line 3—3 of FIG. 2.

In the illustraton of FIG. 2, the solid cross hatched region 150 represents the area of the radial discharge port location for the earliest or maximum opening of the discharge port to the trapped pocket or interlobe volume, that is, the lowest Vi, volume ratio, at which the machine can run. This corresponds to the position at which the leading edges of the male and female crests numbered "2" reach the edge of the discharge port in its full open position, as defined by port 29 and the right end 38 of the slide valve 32 (see FIG. 1).

The dashed cross hatched area 152 represents preferred locations for the earliest opening of sensing port 153. The location of the pocket area 152 must be at least the angle Alpha back from the opening of the discharge port on the female side and the angle Beta back from the discharge port on the male side, in which the angle Alpha is defined as 360° divided by the number of lobes on the female rotor and the angle Beta is defined as 360° divided by the number of lobes on the male rotor. In a conventional compressor as described above, the angle Alpha would be 60° and the angle Beta would be 90°. Thus, the pocket area 152 immediately follows the pocket which is next adjacent to the discharge port but which is not yet in communication with the discharge port. In FIG. 2, the leading edge of pocket 4 of the female rotor enters into open exposure of the sensing port 153 thereby permitting sensing of pressure in the pocket until rotation of the female rotor causes the trailing edge of this pocket to pass the port. A possible location for sensing is indicated in FIG. 2.

The side load injecton port 154 is located according to practices well-known to those skilled in the art. It is preferably located to give a preferred relationship with the suction pressure which results in the best specific performance and improvement in efficiency. It may, in an ordinary case, be located anywhere between, but not in communication with, the suction and discharge ports. A possible location is shown in FIG. 2. The sensing port 153, however, is preferably located later in the compression than the injection port 154 in order to avoid considering the pressure drop in the injection port, itself, and having to correct the measured pressure upwardly. Accordingly, the location of the injection port 154 is preferably ahead of that of the sensing port 153.

In order to sense the pressure, a capillary tube 160 is connected by appropriate fitting 161 into the sensing port location in the housing. The other end of the capillary tube is connected to a dampening chamber 162 to which is connected a pressure transducer 164 having suitable leads 165 to the Analog Input Module ADC, 98.

Considering the structure and operation within a pocket of the lobes of the compressor it will be apparent that the pressure transmitted through the tube 161 is a minimum when the leading rotor tip passes over the port and builds to a maximum as the lagging rotor tip passes over the sensing port. Since in a four lobe male rotor, each lobe is 90° apart, as stated above the transducer must be at least 90° back from the earliest possible opening of the radial discharge port or the transducer would be exposed directly to the system discharge pressure and would not give an accurate indication of the pressure in the trapped pocket.

Consideration of the foregoing indicates a distinction with reference to the Shaw U.S. Pat. No. Re. 29,283. In it, the sensing port 72 is described as sensing the pressure of the working fluid in the trapped volume just before the uncovering of the closed thread to the discharge port. In order to prevent this port from being in a trapped volume open to the system discharge port when the leading tip opens to discharge, in the present invention the sensing port must be back at least 90° wrap of the male rotor from discharge. Since the total wrap is 300° and the sensing port must be at least 90° from the radial port, this indicates that it must be at least approximately one-third of the rotor length back from the radial port. The Shaw patent shows a sensing port which is much closer than this to the radial discharge port. During operation of the compressor, this port would be sensing only the line pressure most of the time, and would provide no useful information about the internal discharge pressure.

Furthermore, the pressure generated in any port in a screw compressor will rise and fall four times per revolution of the male rotor. At a normal 60 Hz two-pole motor speed of 3600 rpm, the pressure pulse would rise and fall 240 times per second. Even if the pressure sensing port in the Shaw patent were located at least 90° back from the radial port, contrary to the disclosure in Shaw, it appears unlikely that a spool valve such as disclosed in Shaw could be directly controlled by this signal. Apparently this spool would be either harmonically excited at 240 Hz to destruction or the signal could be snubber damped to provide an average pressure. However, to use this pressure directly is to use an average pressure, which is not wanted. What is required is an indication of the peak pressure in order to avoid over or under compression.

In the present invention, the structure results in the measurement of trapped pocket pressure at a known location in the screw threads. Such pressure is measured by pressure sensing means which damps the fluctuation in the signal level to an average value. Such pressure level part way through the compression is then used to predict the maximum closed thread pressure before opening to the radial discharge port, based on a conventional relationship or model of a compression process (isentropic, isothermal, polytropic, etc.), and the radial discharge port is then positioned by movement of the slide valve to avoid over or undercompression. This is accomplished in a micro-processor controlled system, such as in the referenced patent application Ser. No. 659,038, to give the compressor an internal volume ratio matched to the pressure ratio of the system.

Figure 5:
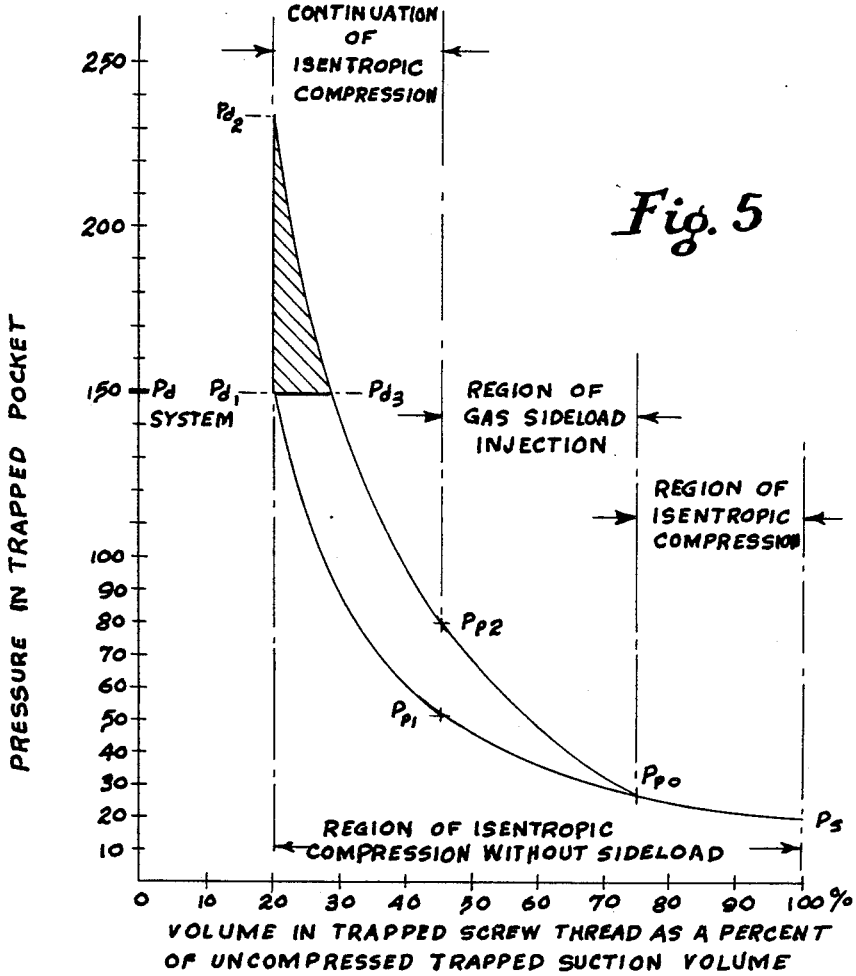
FIG. 5 is a pressure-volume diagram illustrating the work that can be saved in a compressor having a side load inlet port by controlling the location of the radial discharge port.
Figure 4:
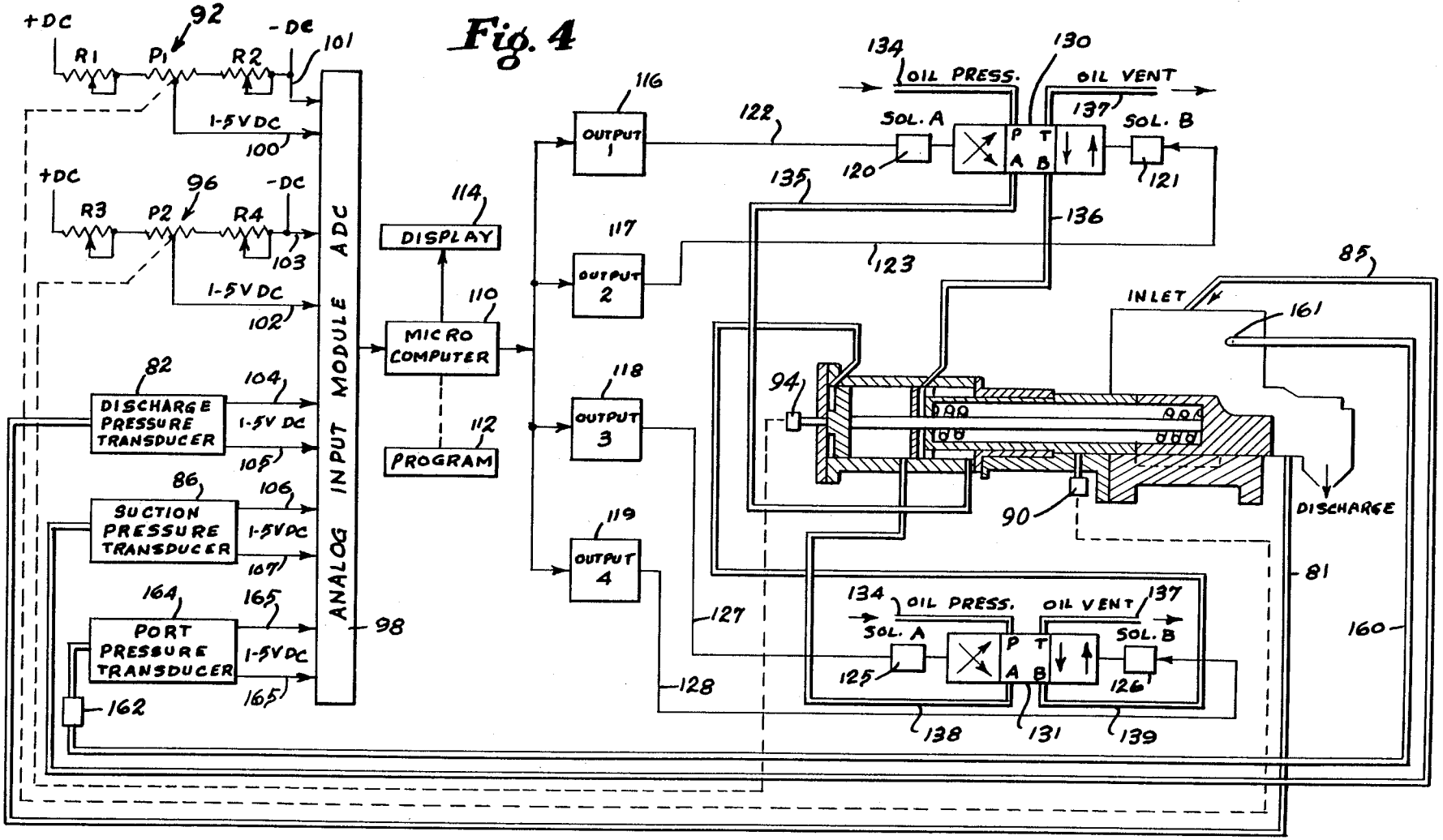
FIG. 4 is a schematic view illustrating the control circuitry and includes the drawing of FIG. 4 from the aforesaid application, Ser. No. 659,038 modified by the addition of control elements in accordance with the present invention, and the deletion of the motor current transducer 140.

FIG. 5 gives an indication of the work that can be saved by readjusting the location of the discharge port based on sensing the pressure later in the compression than the side load inlet port, and therefore of the total content of the interlobe volume.

In the referenced application, Ser. No. 659,038, it is proposed to perform the volume ratio adjustment by measuring the suction and discharge pressures external to the compressor; and based upon modeling or analyzing the compression in some manner, predicting the internal discharge pressure at the point the trapped pocket opens to the discharge port. Different methods of analysis can be used to predict the internal discharge pressure at the point of opening to the discharge port; for example, $P_d/P_s=V_ik$ where $V_i$ is the internal volume ratio and k is the ratio of specific heats—this models the compression as isentropic. As an alternate the compression could be modeled as polytropic with $P_d/P_s=V_in$ where n is the polytropic exponent. (See examples of isentropic and polytropic analyses in ASHRAE Handbook, 1983 Equipment, 12.21-22).

These analyses work quite well providing that the only gas entering the compressor enters at the suction port. However, additional gas may be injected or side loaded into the screw threads later in the compression process, as referred to above. Examples of this type of operation occur where an intermediate pressure port receives flash gas from an economizer vessel or additional gas from a sideload. When this additional gas is injected into the trapped compression area, the pressure at that point is raised above the level that would have resulted by considering only the compression of the suction gas. Thus in order to avoid overcompression at the discharge the volume ratio should be readjusted down based upon (a) the pressure level at the intermediate port and (b) the location of the port in the compression process.

FIG. 5 is a pressure-volume diagram in which the compression of gas is modeled first in a standard screw compressor, then in a screw compressor with vapor injection at an intermediate pressure.

First the standard compression is modeled by curve $P_s$–$P_{p1}$–$P_{d1}$. Assume $P_s = 18.8$ psia $P_{d1} = 150$ psia The compression ratio is $P_d$ system/$P_s$ or 150/18.8=7.98:1 and the ideal volume ratio would be $$V_i = CR^{1/k} = 7.98^{1/1.29} = 5;$$

assuming a compression exponent of 1.29. The volume ratio can be found on FIG. 5 by taking 20% volume at discharge compared to 100% volume at suction to yield $$V_i = 100\%/20\% = 5$$

Thus the compression in this case is ideal, i.e., the internal discharge pressure from the compressed pocket opens to the discharge port when the pressures are equalized, without over or undercompression.

The upper curve of FIG. 5 illustrates the compression model with gas sideload injection (curve Ps–$P_{po}$–$P_{p2}$–$P_{d3}$–$P_{d2}$.

Compression of the suction gas can be modeled in some fashion from $P_s$ to $P_{po}$ (in this example as isentropic compression). From $P_{po}$ to $P_{p2}$ the compression pocket is open to the side port and gas is flowing into the trapped pocket raising the pocket pressure by 36 psi to $P_{p2}$ by the time the pocket closes to the port. From $P_{p2}$ to $P_{d2}$ the compression again follows an isentropic compression model ending the compression when the pocket opens to the radial discharge port of the slide valve, assuming the radial port is still located at $V_i = 5$ from suction.

In order to save the work expended in compressing above $P_d$ system, it is necessary to relocate the radial discharge port to a position giving a volume of 28% so the compression will cease at $P_{d3}$ and gas will be pushed out of the compressor at 150 psia.

The $V_i$ at 28% volume is 100%/28%=3.57 with reference to suction.

The calculations necessary to relocate the radial discharge port require sensing of the pressure following the side load injection, $P_{p2}$, and in the discharge line from the compressor, $P_d$ system. (The latter sensing is provided in application Ser. No. 659,038.) These readings are fed through the Analog Input Module, Analog to Digital Converter 98, to the Micro Computer 110.

Thus the two pressure levels $P_{p2}$ and $P_d$ system are measured and the ideal compression ratio is calculated by $CR = P_d/P_{p2}$. For the example in FIG. 5, this would be 150/80=1.875CR. In order to avoid overcompression the internal compression ratio of the compressor from closing of the sideload port to discharge must be equal to the ideal CR.

Since the trapped volume when the port closes in this example is 45% the ideal discharge volume can be calculated as follows:

$V_{pp2}$ = trapped volume at port closure = 45% of suction volume

CR = 1.875 ideal volume ratio port closure to discharge = $V_{ii}$ $$V_{ii} = \text{ideal } CR^{1/k}$$

$$= 1.875^{1/1.29} = 1.628$$

So, ideal volume at opening to the discharge port should be $$V_{ii} = \frac{V_{pp2}}{V_d} = 1.628 = \frac{45}{V_d}$$

$$V_d = 27.6\%$$

By referring to a table in the microcomputer of actual volume at discharge for each radial port location, the movable slide stop and slide valve can be adjusted to the correct discharge volume to give minimum power consumption.

We claim:

1. In a rotary screw compressor having a housing with a primary inlet means and an outlet means, a pair of mating rotors and slide valve means intermeshing with the rotors and housing and moveable to vary the capacity and volume ratio of the compressor, said rotors and said slide valve means forming with the housing a succession of independent closed pockets whose volume varies from a maximum, in the pocket adjacent to the primary inlet means to a minimum in the pocket next adjacent to the outlet means, immediately before its connection with the outlet means, the improvement comprising, means for sensing the pressure in the pocket which immediately follows the pocket next adjacent to the outlet means, said pressure sensing means communicating with said pressure sensed pocket by port means in said housing, and means for using said sensed pressure to control the movement of said slide valve means.

2. In a rotary screw compressor having a housing with a primary inlet means and an outlet means, a pair of mating rotors and slide valve means intermeshing with the rotors and housing and moveable to vary the capacity and volume ratio of the compressor, said rotors and said slide valve means forming with the housing a succession of independent closed pockets whose volume varies from a maximum, in the pocket adjacent to the primary inlet means to a minimum in the pocket next adjacent to the outlet means, immediately before its connection with the outlet means, and in which a secondary inlet means for gas is provided with communicates with a pocket whose volume is between the maximum volume and the minimum volume, the improvement comprising, means for sensing the pressure in the pocket which immediately follows the pocket next adjacent to the outlet means and at a position no earlier in the compression than that of the secondary inlet means, said pressure sensing means communicating with said pressure sensed pocket by port means in said housing, and means for using said sensed pressure to control the movement of said slide valve means.

3. The invention of claim 1, in which the pressure sensing means is later in the compression than that of the secondary inlet means.

4. The invention of claim 1 in which the pressure sensing means is later in the compression than that of the secondary inlet, means for sensing the pressure at the outlet means, means for varying the position of the outlet means and thereby the internal volume ratio, and means for controlling the position of the outlet means in response to said sensed pressures.

5. The invention of claim 1 in which the pressure sensing means is a capillary tube connected to a dampening chamber, and a pressure sensing transducer mounted to sense the pressure in the dampening chamber.

6. In a rotary screw compressor having a housing with a primary inlet means and an outlet means, a pair of mating rotors, in which the female rotor has a plurality of lobes spaced Alpha degrees apart and in which the male rotor has a plurality of lobes spaced Beta degrees apart and slide valve means intermeshing with the rotors and housing and moveable to vary the capacity and volume ratio of the compressor, said rotors and said slide valve means forming with the housing a succession of independent closed pockets whose volume varies from a maximum, in the pocket adjacent to the primary inlet means, to a minimum in the pocket next adjacent to the outlet means immediately before its connection with the outlet means, and in which a secondary inlet means for gas communicates with a pocket whose volume is between the maximum volume and the minimum volume, the improvement comprising, means for sensing the pressure in the pocket which is at least Alpha degrees back from the outlet means on the female side or at least Beta degrees back from the outlet means on the male side, and at a position no earlier in the compression than that of the secondary inlet means, said pressure sensing means communicating with said pressure sensed pocket by port means in said housing, and means for using said sensed pressure to control the movement of said slide valve means.

7. The invention of claim 3, in which the pressure sensing means is later in the compression than that of the secondary inlet means.

8. The invention of claim 3 in which Alpha is approximately 60° and Beta is approximately 90°.

9. The invention of claim 3 in which the pressure sensing means is a capillary tube connected to a dampening chamber, and a pressure sensing transducer mounted to sense the pressure in the dampening chamber.

10. In a rotary screw compressor having a housing with a primary inlet means and an outlet means, and a pair of mating rotors, in which the female rotor has a plurality of lobes spaced Alpha degrees apart and in which the male rotor has a plurality of lobes spaced Beta degrees apart, and slide valve means intermeshing with the rotors and housing and moveable to vary the capacity and volume ratio of the compressor, said rotors and said slide valve means forming with the housing a succession of independent closed pockets whose volume varies from a maximum, in the pocket adjacent to the primary inlet means, to a minimum in the pocket next adjacent to the outlet means immediately before its connection with the outlet means, and in which a secondary inlet means for gas communicates with a pocket whose volume is between the maximum volume and the minimum volume, the improvement comprising, means for sensing the pressure in the pocket which is at least Alpha degrees back from the outlet means on the female side or at least Beta degrees back from the outlet means on the male side, and at a position later in the compression than that of the secondary inlet means, in which Alpha is approximately 60° and Beta is approximately 90°, said pressure sensing means communicating with said pressure sensed pocket by port means in said housing, and means for using said sensed pressure to control the movement of said slide valve means.

11. The invention of claim 10 in which the pressure sensing means is a capillary tube connected to a dampening chamber, and a pressure sensing transducer mounted to sense the pressure in the dampening chamber.

12. In a rotary screw compressor having a primary inlet means and an outlet means, and a pair of mating rotors, in which the female rotor has a plurality of lobes spaced Alpha degrees apart and in which the male rotor has a plurality of lobes spaced Beta degrees apart, and forming with the housing a succession of independent closed pockets whose volume varies from a maximum, in the pocket adjacent to the primary inlet means, to a minimum in the pocket next adjacent to the outlet means immediately before its connection with the outlet means, and in which a secondary inlet means for gas communicates with a pocket whose volume is between the maximum volume and the minimum volume, the improvement comprising, means for sensing the pressure in the pocket which is at least Alpha degrees back from the outlet means on the female side or at least Beta degrees back from the outlet means on the male side, and at a position later in the compression than that of the secondary inlet means, in which Alpha is approximately 60° and Beta is approximately 90°, in which said pressure sensing means is a capillary tube connected to a dampening chamber, and a pressure sensing transducer mounted to sense the pressure in the dampening chamber, and in which the transducer provides an analog voltage output and is connected to an analog to digital converter for controlling the position of the outlet means in response to said sensed pressures.

* * * * *

UNITED STATES PATENT AND TRADEMARK OFFICE

CERTIFICATE OF CORRECTION

PATENT NO. : 4,609,329

DATED : September 2, 1986

INVENTOR(S) : Joseph W. Pillis and Hans C. Wile

It is certified that error appears in the above—identified patent and that said Letters Patent is hereby corrected as shown below:

Claim 3, line 1, change "claim 1" to --claim 2--.

Claim 4, line 1, change "claim 1" to --claim 2--.

Claim 5, line 1, change "claim 1" to --claim 2--.

Claim 7, line 1, change "claim 3" to --claim 6--.

Claim 8, line 1, change "claim 3" to --claim 6--.

Claim 9, line 1, change "claim 3" to --claim 6--.

Signed and Sealed this

Twenty-sixth Day of April, 1988

*Attest:*

DONALD J. QUIGG

*Attesting Officer*

*Commissioner of Patents and Trademarks*